US006499962B1

(12) United States Patent
Keiner et al.

(10) Patent No.: US 6,499,962 B1
(45) Date of Patent: Dec. 31, 2002

(54) BEARING ARRANGEMENT FOR A SWASH PLATE PUMP

(75) Inventors: Bernd Keiner, Waiblingen (DE); Erich Moritsch, Plochingen (DE); Juergen Kloepfer, Burgstetten (DE)

(73) Assignee: Alfred Kaercher GmbH & Co., Winnenden (DE)

( * ) Notice: Subject to any disclaimer, the term of this patent is extended or adjusted under 35 U.S.C. 154(b) by 0 days.

(21) Appl. No.: 09/611,929

(22) Filed: Jul. 7, 2000

Related U.S. Application Data

(63) Continuation of application No. PCT/EP98/08332, filed on Dec. 18, 1998.

(30) Foreign Application Priority Data

Jan. 10, 1998 (DE) ..... 198 00 680

(51) Int. Cl.[7] ..... F04B 1/12; F04B 1/00; F04B 19/00; F01B 3/00

(52) U.S. Cl. ..... 417/269; 417/271; 417/470; 92/71

(58) Field of Search ..... 417/269, 271, 417/470, 415; 92/71

(56) References Cited

U.S. PATENT DOCUMENTS

| | | | | | |
|---|---|---|---|---|---|
| 2,241,046 | A | * | 5/1941 | Wahlmark | 121/119 |
| 3,438,686 | A | * | 4/1969 | Stone | 308/238 |
| 3,981,630 | A | * | 9/1976 | Leduc et al. | 417/269 |
| 4,403,924 | A | * | 9/1983 | Gebauer et al. | 417/388 |
| 4,870,893 | A | * | 10/1989 | Takahashi et al. | 92/71 |
| 5,038,673 | A | * | 8/1991 | Schulze | 92/71 |
| 5,058,485 | A | * | 10/1991 | Cardillo | 91/485 |
| 5,934,887 | A | | 8/1999 | Veit | 417/417 |

FOREIGN PATENT DOCUMENTS

| | | | | |
|---|---|---|---|---|
| DE | 41 06 955 | * | 9/1992 | F04B/1/14 |
| DE | 91 12 170 U | | 11/1992 | F04B/1/14 |
| WO | WO 96/17694 | | 6/1996 | B08B/3/02 |

OTHER PUBLICATIONS

Marks' Standard Handbook For Mechanical Engineers; 10$^{th}$ edition, McGraw Hill, 1966. pp. 8–132 and 8–133.*

Fachkunde für metallverarbeitende Berufe, 31. Auflage, Verlag Willing & Co. Europa–Lehrmittel O.H.G. Wuppertal 1965, pp. 120–128.

* cited by examiner

*Primary Examiner*—Charles G. Freay
*Assistant Examiner*—Timothy P. Solak
(74) *Attorney, Agent, or Firm*—Barry R. Lipsitz

(57) ABSTRACT

A swash-plate-end bearing for the motor shaft in a high pressure cleaning appliance which includes a motor and a reciprocating pump driven thereby, wherein the pistons of said pump rest resiliently on a swash plate driven by the motor whose shaft is rotatably mounted at each end whilst being connected at one end in non-rotatable manner to the swash plate, and which also includes at the swash plate end, a roller bearing having two concentric bearing rings, whereby the outer bearing ring is held in an end plate of the motor whilst the inner bearing ring surrounds the motor shaft, in such a manner as to simplify the operation of assembling the motor shaft and the bearing and to make it as independent as possible from unavoidable manufacturing tolerances, it is proposed that the inner bearing ring should surround the motor shaft in floating manner.

10 Claims, 1 Drawing Sheet

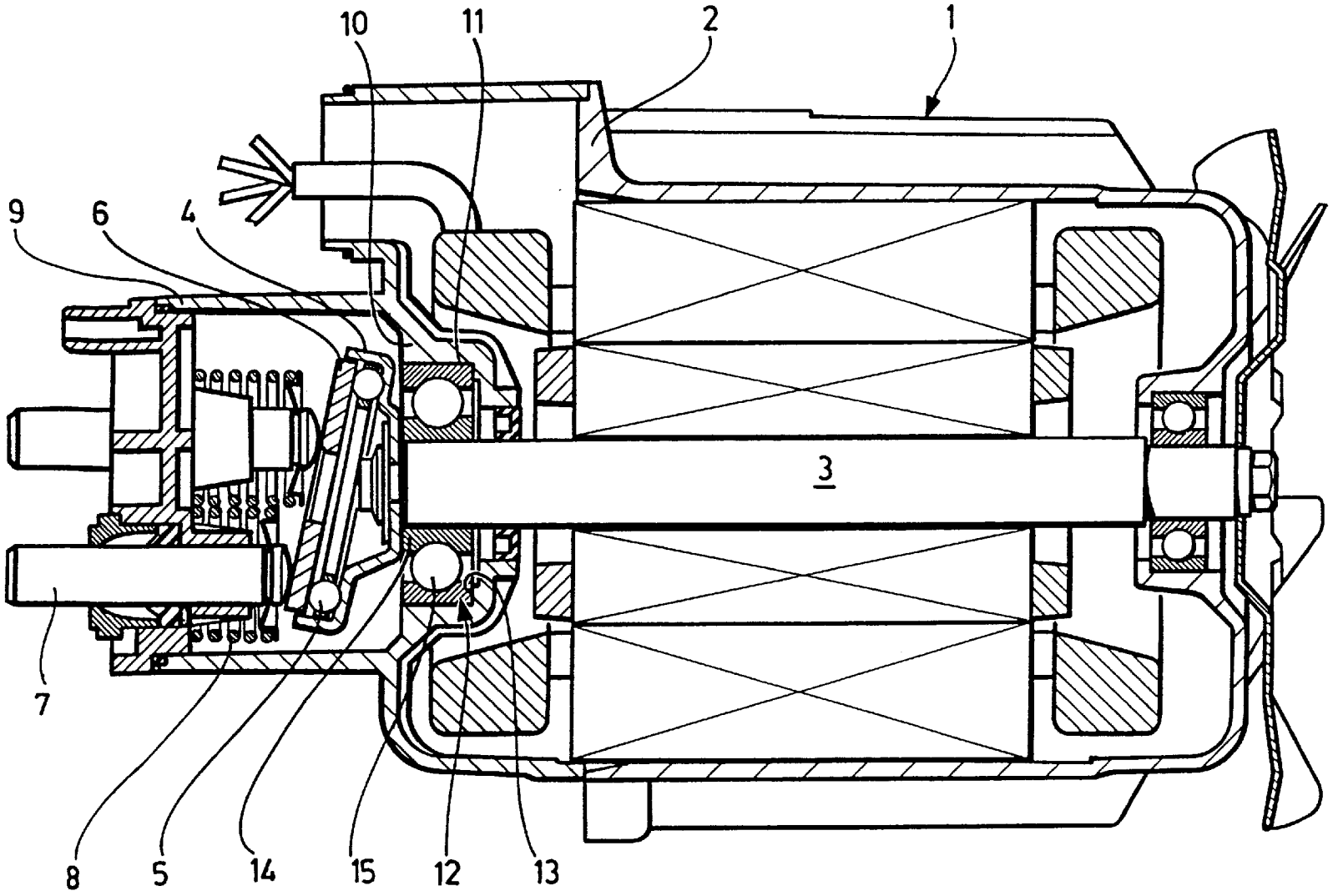
1
2
3
4
5
6
7
8
9
10
11
12
13
14
15

BEARING ARRANGEMENT FOR A SWASH PLATE PUMP

The present invention relates to the subject matter disclosed in international application PCT/EP 98/08332 of Dec. 18, 1998.

BACKGROUND OF THE INVENTION

The invention relates to a high pressure cleaning appliance including a motor and a reciprocating pump driven thereby, whereby the return springs for the pistons of said pump rest on a swash plate driven by the motor whose shaft is rotatably mounted at each end whilst being connected at one end in non-rotatable manner to the swash plate, and including at the swash plate end, a roller bearing having two concentric bearing rings, whereby the outer bearing ring is held in an end plate of the motor whilst the inner bearing ring surrounds the motor shaft.

In known high pressure cleaning appliances having this type of construction, the motor shaft is guided in a roller bearing at the swash plate end whereby the roller bearing is connected in non-rotatable manner to both the motor shaft and the end plate of the motor (WO 96/17694). These non-rotatable connections can be obtained by shrinking the inner bearing ring of the roller bearing onto the motor shaft and by clamping the outer bearing ring in the end plate of the motor. Consequently, the slightest variations in the diameter of the motor shaft or the bearing rings of the roller bearing, which variations are attributable to manufacturing tolerances, have a disadvantageous effect when it comes to assembling the arrangement. Alternatively, a non-rotatable connection of the roller bearing to the motor shaft can be obtained by providing the motor shaft with a shoulder so that the roller bearing can be clamped between this shoulder and the swash plate through the formation of a friction-fit. However, the process of forming this shoulder on the motor shaft increases the cost of manufacture.

SUMMARY OF THE INVENTION

Consequently, the object of the invention is to design the bearing arrangement for the motor shaft at the swash plate end in such a manner as to simplify the operation of assembling the motor shaft and the bearing and to make it as independent as possible from unavoidable manufacturing tolerances This object is achieved in a high pressure cleaning appliance of the type described hereinabove in that the inner bearing ring surrounds the motor shaft in floating manner (e.g., via a sliding fit or a non-interference fit). As a result of this arrangement, it is no longer necessary to shrink the inner bearing ring of the bearing at the swash plate end onto the motor shaft.

It is particularly advantageous if the outer bearing ring rests loosely (e.g., via a sliding fit or a noninterference fit) in a seating in said end plate, whereby said seating locates the outer bearing ring in the radial and axial directions. The seating in the end plate thus forms a stop for the rolling contact bearing in the axial and radial directions so that the motor shaft can be localised in at least the radial direction.

In a preferred embodiment of the invention, provision is made for the seating to be open towards the swash plate. This simplifies assembly since the rolling contact bearing can be inserted into the seating from the piston end.

It is particularly advantageous if the motor shaft and the swash plate are pressed into the motor resiliently by the piston. It is typical for the housings of the motor and the pump to be rigidly connected together. The pistons of the pump are surrounded by springs which are supported on the pump housing and press the pistons against the swash plate. The axis of the pistons and the longitudinal axis of the motor shaft generally extend in parallel. The piston return springs thereby press the swash plate and the motor shaft affixed thereto towards the motor housing.

It is propitious if the depth to which the motor shaft can be inserted is limited by a stop. The motor shaft is supported on the motor housing via the stop. The counter-force to the force exerted by the piston return springs is applied to the motor shaft by the stop so that the motor shaft can be localised in the axial direction.

In a preferred embodiment of the invention, provision is made for the stop to be formed by the bearing for the motor shaft whereby, for its part, said bearing is supported on the end plate of the motor. In this way, the force of the piston return springs is effective via the rolling contact bearing on the end plate of the motor. The rolling contact bearing is thus pressed against the motor housing by the force of the piston return springs.

It is particularly advantageous if the end face of the swash plate rests on the bearing at the swash plate end. A connection is thereby produced between the bearing at the swash plate end and the motor shaft since the swash plate is connected to the motor shaft in non-rotatable manner. The inner bearing ring only surrounds the motor shaft in floating manner.

Basically, provision may be made for the end face of the swash plate to rest on the inner bearing ring of the bearing at the swash plate end. Since the swash plate does not touch the two bearing rings simultaneously, it is thereby ensured that the bearing rings can rotate relative to one another.

It is particularly propitious if the seating is in the form of an open-ended shell incorporating an inwardly projecting step, and if the inner bearing ring does not rest on the step. As previously described, the spring forces of the piston return springs are effective on the swash plate which, in turn, is connected to the motor shaft in a non-rotatable manner. The swash plate however, is supported on the inner bearing ring of the rolling contact bearing. The outer bearing ring rests loosely in the open-ended shell incorporating an inwardly projecting step. This results in a frictional connection which conveys the effective force of the piston return springs to the step in the end plate via the swash plate, the inner bearing shell, the ball- or roller-bearings and the outer bearing shell. The selection of piston return springs having appropriately large spring constants results in the swash plate and hence the motor shaft being pressed into the motor block via the rolling contact bearing in such a manner that a friction-fit is formed between the swash plate and the inner bearing shell, and also between the outer bearing shell and the end plate. A non-rotatable connection of the motor shaft and the inner bearing shell on the one hand and of the outer bearing shell and the end plate on the other as is known from the state of the art is thereby superfluous.

In a preferred embodiment, provision is made for the rolling contact bearing to be in the form of a ball bearing.

The following description of a preferred embodiment of the invention taken in conjunction with the drawing will serve to provide a more detailed explanation.

BRIEF DESCRIPTION OF THE DRAWINGS

The FIGURE shows a longitudinal section through an electric motor of a high pressure cleaning appliance having a reciprocating pump coupled thereto.

DETAILED DESCRIPTION OF THE INVENTION

The electric motor 1 of the high pressure cleaning appliance illustrated in the Figure comprises a housing 2 in which a horizontally extending motor shaft 3 is disposed. The free end of the motor shaft 3 projecting out from the electric motor 1 carries a swash plate 4 in which a pressure plate 6 is rotatably mounted on a ball bearing 5. The pistons 7 of a reciprocating pump, which is not illustrated in detail in the drawing, are supported on the pressure plate 6 and are pressed thereagainst by the coil springs 8 which surround the pistons 7. The electric motor 1 is accommodated in a housing 2 to which there is attached a pump housing 9 that surrounds the swash plate 4, the pistons 7 and the not-illustrated pump. A transverse wall 10 forms an end plate in the transition region, and the outer cage 11 of a ball bearing for mounting the motor shaft 3 in said transverse wall 10 is supported therein. In order to serve as an end plate, the transverse wall 10 is provided with a two-step construction, whereby the second step 13 is made just wide enough as to support only the outer cage 11 of the ball bearing 12 on said step 13. The inner cage 14 of the ball bearing 12 surrounds the motor shaft 3 in floating manner. The swash plate 4 extends over the end face of the motor shaft 3 in the radial direction just so far as to overlap the inner cage 14 of the ball bearing 12 but not so as to touch the outer cage 11. The swash plate 4 is connected to the motor shaft 3 in non-rotatable manner via a not-illustrated tie-rod for example.

The coil springs 8 are supported on the pump housing and press the pistons 7 against the swash plate 4. For its part, the latter is in contact with the inner cage 14 of the ball bearing 12 which is effective on the outer cage and hence on the step 13 of the transverse wall 10 in the housing 2 by virtue of a frictional connection via the ball-bearings 15. With the present invention, the non-rotatable connection between the inner cage 14 and the motor shaft 13 found in conventional prior art cleaning appliances, formed by shrinking the inner cage 14 onto the motor shaft 3, is no longer necessary. The pressure exerted by the coil springs 8 is so large that a friction-fit is formed between the swash plate 4 and the inner cage 14 and also between the outer cage 11 and the step 13, which thereby implements a quasi-non-rotatable connection between the motor shaft 3 and the inner cage 14 via the swash plate 4 and also another non-rotatable connection between the outer cage 11 and the transverse wall 10 or the step 13.

Above all, this embodiment simplifies the operation of assembling the high pressure cleaning appliance and allows for greater manufacturing tolerances in regard to the diameters of the bearing rings and the motor shaft. The ball bearing 12 is simply laid in the two-step recess in the transverse wall 10 and the motor shaft 3 connected in non-rotatable manner to the swash plate 4 is inserted into the electric motor 1

What is claimed is:

1. A high pressure cleaning appliance including a reciprocating pump driven by a motor, wherein:

said pump comprises pistons that rest resiliently on a swash plate driven by the motor;

said motor has a shaft rotatably mounted at first and second ends thereof;

the first end of said shaft is fixedly mounted to the swash plate and is supported by a rolling contact bearing having concentric outer and inner bearing rings, said outer bearing ring being supported in an end plate of the motor and the inner bearing ring supporting the motor shaft;

the motor shaft is free to move axially and rotationally within the inner bearing ring; and said pistons bear against said swash plate with a force sufficient to press the swash plate into a friction-fit with the inner bearing ring, thereby positioning and maintaining the motor shaft in an operational state within the motor.

2. An appliance in accordance with claim 1, wherein said force pressing the swash plate into a friction-fit with the inner bearing ring also maintains the outer bearing ring in a seating in said end plate.

3. An appliance in accordance with claim 2, wherein the seating is open towards the swash plate.

4. An appliance in accordance with claim 2, wherein the seating is in the form of an open-ended shell incorporating an inwardly projecting step, and in that the inner bearing ring does not rest on the step.

5. An appliance in accordance with claim 1, wherein the motor shaft and the swash plate are pressed resiliently into the motor by the pistons.

6. An appliance in accordance with claim 5, wherein the depth to which the motor shaft can be inserted is limited by a stop.

7. An appliance in accordance with claim 6, wherein:

the stop is formed by the bearing for the motor shaft; and said bearing is supported on a bearing plate of the motor.

8. An appliance in accordance with claim 7, wherein the end face of the swash plate rests on the bearing at the swash plate end.

9. An appliance in accordance with claim 8, wherein the end face of the swash plate rests on the inner bearing ring of the bearing at the swash plate end.

10. An appliance in accordance with claim 1, wherein the rolling contact bearing is in the form of a ball bearing.

* * * * *